United States Patent [19]

Pester

[11] Patent Number: 4,574,564

[45] Date of Patent: Mar. 11, 1986

[54] METHOD AND APPARATUS FOR WRAPPING MACHINE

[75] Inventor: Andrew L. Pester, Belle Mead, N.J.

[73] Assignee: Hobart Corporation, Troy, Ohio

[21] Appl. No.: 639,962

[22] Filed: Aug. 10, 1984

[51] Int. Cl.[4] ..... B65B 59/02

[52] U.S. Cl. ..... 53/441; 53/446; 53/210; 53/556

[58] Field of Search ..... 53/441, 442, 556, 466, 53/210, 206, 222, 223

[56] References Cited

U.S. PATENT DOCUMENTS

| | | | |
|---|---|---|---|
| 3,662,513 | 5/1972 | Fabbri | 53/226 X |
| 3,861,114 | 1/1975 | Jason et al. | 53/442 |
| 3,967,433 | 7/1976 | Bonfiglioli | 53/466 X |
| 4,388,796 | 6/1983 | Zelnick | 53/222 X |
| 4,501,106 | 2/1985 | Treiber et al. | 53/556 X |

OTHER PUBLICATIONS

Mathieu, U.S. patent application Ser. No. 371,892, filed Apr. 26, 1982 for "Film Wrapping Machine Including Film Length Selection."

*Primary Examiner*—James F. Coan

*Attorney, Agent, or Firm*—Biebel, French & Nauman

[57] ABSTRACT

A package is conveyed to a package elevator which elevates it into a film sheet stretched above the elevator. Side folding levers and a coordinated rear folder fold three sides of the film sheet about the package such that edges of first and second opposed sides of the film sheet are overlapped by edges of a third or rear side of the film sheet. The infolding of the third side of the film sheet by the side underfolders is delayed at the rear edge of the package by expanding the opening between the side underfolders in that area. Thus, the rear underfolding of the third side commences substantially at the rear corners of the package to expand the underfolded third side and ensure film overlap. The package is then pushed onto a conveyor to underfold the fourth side of the film and entirely cover the underside of the package by overlapping edges of the folded sides of the film sheet. The infolding is delayed by an improved side folding lever having a curvilinear folding edge with a notch formed at its inner end in substantial alignment with the rear edge of the largest packages to be wrapped using the folding lever. Preferably, the notches comprise curvilinear trailing edges which serve to tuck and roll the edges or infolded portions of the third or rear side of the film sheet as it is rear underfolded.

11 Claims, 10 Drawing Figures

PRIOR ART

METHOD AND APPARATUS FOR WRAPPING MACHINE

BACKGROUND OF THE INVENTION

This invention relates generally to a machine for wrapping a film sheet about a package by means of pivoting side folding levers and a coordinated rear folder and, more particularly, to an improved method and apparatus for folding film in such a wrapping machine.

A popular design of film wrapping machine provides for the wrapping of packages, particularly articles supported on trays, by elevating the packages into stretched film sheets. The length and width of each film sheet is selected to correspond to the package to be wrapped and the sheet is stretched above an elevator supporting the package. The package is elevated into the stretched film sheet and three sides of the sheet are folded under the package by means of side folding levers or underfolders and a coordinated rear folder or underfolder. The fourth side of the film sheet is folded under the package as the package is ejected onto an exit conveyor. Such a wrapping machine is fully described in U.S. Pat. No. 4,510,731, entitled "Film Wrapping Machine Including Film Length Selection," which is assigned to the same assignee as the present application and is incorporated herein by reference.

The film wrapping machine disclosed in the referenced patent can wrap a wide range of package sizes having base dimensions which vary from approximately 5 inches by 5 inches to approximately 9 inches by 12 inches in two different width films. While a large variety of film widths are available, two standard width films used by the machine are 14 inches and 18 inches. In many applications, as many as twenty differing package sizes are wrapped by the machine by selecting an appropriate width and length of film to be wrapped about each of the packages. However, the maximum size package which can be wrapped by the machine is limited by the width of the package handling path through the machine and/or the width and length of film which can be drawn into the machine to wrap a package.

Oversized packages which have dimensions exceeding 9 inches by 12 inches and often referred to herein as family sized packages or "family packs," can be wrapped by the machine in the larger standard width film used by the machine. Unfortunately, the edges of the underfolded sides of a sheet of such film used to wrap a family pack by the machine are not completely overlapped with one another. Without complete overlapping of the edges of the underfolded sides of the film sheet, unacceptable gaps are formed in the wrappings on the undersides of the packages. While film adheres well to itself and the adhesion can be strengthened by the application of heat, film does not adhere well to typical packages or trays used to support articles to be wrapped. Unless an overlapping seal is formed, the wrap about a package would be loose and unacceptable, particularly for food products.

To overcome the problem and be able to wrap family packs, the existing wrapping machine has been modified to expand the package handling path and permit wider 21 inch film to be used by the machine. However, such changes are expensive and require the modification or replacement of a large portion of the wrapping machine. Further, the wider film is a continuing increased expense in operating the machine.

Alternately, adjustments to the film pulling apparatus or replacement of the film pulling apparatus to provide extended film draw are possible. With extended film draw, family packs can be accommodated by feeding such packages into the machine lengthwise rather than in the standard widthwise manner. While such an approach may be economically more attractive than widening the existing wrapping machine, it still requires the modification or replacement of a substantial portion of the machine or repeated adjustments to the machine such that both the standard range of package sizes and the larger family sized packages can be wrapped.

It is, thus, apparent that the need exists for an improvement to existing film wrapping machines such that family sized packages can be wrapped in a standard width film used by the machines. To be practical, the improvement cannot require extensive changes to the wrapping machines and must permit the machines to wrap packages within the standard wide range of package sizes which normally comprise the majority of the packages wrapped.

SUMMARY OF THE INVENTION

In accordance with the present invention, an improved method and apparatus are provided for wrapping family sized or oversized packages in a standard width film in the normal widthwise manner on a wrapping machine which could not otherwise satisfactorily wrap such oversized packages. Alternately, the method and apparatus of the present invention permit a narrower film width to be used to wrap the largest sized packages presently wrapped by a wrapping machine. Hence, by utilizing the method and apparatus of the present invention, larger packages can be wrapped by existing wrapping machines, and also substantial amounts of wrapping film can be saved in wrapping packages within the standard package size range. The method and apparatus of the present invention also enable new machines to wrap a wider range of package sizes in a given width film.

The method of the present invention is performed by an improved side folding lever for a film wrapping machine. The improved side folding lever can be installed on new machines in place of the prior art folding lever and quickly and conveniently installed to replace existing folding levers on machines currently in the field. By replacing the folding levers, wrapping machine performance is improved to save film for selected package sizes within the standard package size range wrapped by the machine and/or to wrap larger oversized package sizes beyond the standard range, such as family sized packages.

The method of wrapping a package in a film sheet in accordance with the present invention comprises conveying the package to a wrapping station which includes a package elevator, securing a film sheet above the package, and elevating the package into the film sheet. Side folding levers or underfolders and a coordinated rear folder or underfolder fold three sides of the film sheet about the package such that the edges of first and second opposed sides of the film sheet are overlapped by the edges of a third or rear side of the film sheet to substantially cover the underside of the package.

The infolding of the third side of the film sheet performed by the side underfolders is delayed at the rear edge of the package by expanding the opening between the side underfolders in that area such that the underfolding of the third or rear side of the film sheet by the rear underfolder commences substantially at the rear corners of the package to ensure that the edges of the third side are beneath the package and that they overlap the edges of the first and second opposed sides of the film sheet. The package is ejected from the wrapping station onto a conveyor to fold the fourth or remaining side of the film sheet onto the underside of the package such that the underside of the package is entirely covered by the folded sides of the film sheet the edges of which overlap and adhere to one another to ensure secure wrapping of the package.

The step of expanding the opening between the side underfolders adjacent the rear edge of a package to be wrapped is performed in the illustrated embodiment by forming notches into folding edges of the side underfolders. The trailing edges of the notches are preferably shaped to perform the further step of tucking and rolling the edges or infolded portions of the third or rear side of the film sheet as it is folded beneath a package by the rear underfolder.

An improved folding lever in accordance with the present invention comprises a planar folding blade with pivot means located near one end for mounting the blade for horizontal pivotal movement about the pivot means. A curvilinear folding edge is formed into the side of the folding blade and terminates in a rounded distal end. Notch means is formed at the inner end of the curvilinear folding edge in substantial alignment with the rear edge of the largest packages to be wrapped using the folding lever. The notch receives a film sheet as it is folded about a package by the improved folding lever or side underfolder. Accordingly, by utilizing a pair of the improved side underfolders of the present invention, the edges or infolded portions of the third or rear side of the film sheet are positioned by the improved side underfolders to be substantially at the rear corners of the largest packages as the third or rear side of the film sheet is engaged by the rear folder or underfolder.

In the illustrated embodiment of the present invention, the notches comprise curvilinear trailing edges which serve to tuck and roll the edges or infolded portions of the third or rear side of the film sheet as it is folded by the rear underfolder. Where the wrapping machine is to accommodate an extended range of package sizes, the curvilinear folding edges of the folding blades beyond the notches, i.e., between the notches and the rounded distal ends, folds film about packages smaller than those accommodated by the notches to position the edges or infolded portions of the third or rear sides of film sheets substantially at the corners of such smaller packages as the third or rear sides of the film sheets are engaged by the rear underfolder.

In the illustrated embodiment of the improved side folding lever of the present invention, the pivot means comprises an aperture for mounting the blade to the wrapping machine. Advantageously, a cam surface may be formed into the folding blade such that a cam driver connected to the rear underfolder and driven along the cam surface serves to pivot the folding blade about the pivot means.

It is, therefore, an object of the present invention to provide an improved method and apparatus for wrapping an oversized package in a standard width film sheet where three sides of the film sheet are folded about the package such that the edges of the third or rear side are positioned substantially at the rear corners of the oversized package as the third or rear side is engaged to be underfolded to ensure that the edges of the third side overlap the edges of the first and second opposed sides of the film sheet whereby the underside of the oversized package is substantially covered by a standard width film which is narrower than the film width normally required to accommodate the oversized package; to provide an improved method and apparatus for wrapping a package in a film sheet wherein first and second opposed sides of the film sheet are folded about the package by means of pivoting side underfolders which include notches to receive the film sheet at a point substantially even with the rear edge of the package to thereby delay the infolding of the first and second opposed sides of the film sheet at the rear edge of the package such that the edges or infolded portions of the third or rear side of the film sheet are underfolded from substantially the rear corners of the package to extend closer to the edges of the package and thereby overlap the edges of the first and second opposed sides of the film sheet; and, to provide an improved method and apparatus for wrapping a film sheet about a package by means of a pair of improved folding levers which each define a curvilinear folding edge having a notch formed at its inner end for receiving a film sheet as it is folded about a package such that the side infolding of the third or rear side of the film sheet is delayed to expand the width of the third or rear side of the film sheet as it is folded by a rear underfolder.

Other objects and advantages of the invention will be apparent from the following description, the accompanying drawings and the appended claims.

DETAILED DESCRIPTION OF THE INVENTION

Figure 1:
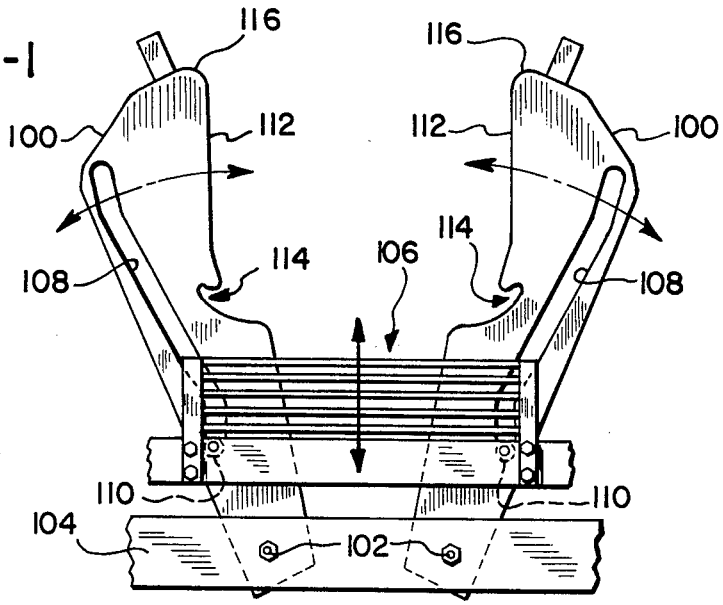
FIG. 1 shows improved side folding levers mounted on a package wrapping machine.

FIG. 1 shows improved side folding levers or side underfolders 100 in accordance with the present invention. In the illustrated embodiment, the side underfolders 100 comprise wing-shaped planar folding blades mounted for horizontal pivotal movement by pivot means which comprise apertures through the ends of the folding blades. Bolts 102 are connected through the apertures to secure the side underfolders 100 to a fixed member 104 of the wrapping machine.

The side underfolders 100 are pivotally closed to fold or wipe first and second opposed sides of a film sheet under the sides of a package being wrapped and opened to permit a package to be elevated between the side underfolders 100. A rear underfolder 106 folds a third or rear side of the film sheet under the package. The general operation of the side underfolders 100 and the rear underfolder 106 to wrap a package in a film sheet are described in the referenced patent and are well known in the art.

A curvilinear cam surface 108 is formed into each of the side underfolders 100. Each cam surface 108 receives a cam driver 110 which is connected to and moved with the rear underfolder 106. As the rear underfolder 106 is moved toward a package, in the upward direction as shown in FIG. 1, the side underfolders 100 are simultaneously pivoted inwardly about the bolts 102. As the rear underfolder 106 is moved in the opposite direction, the side underfolders 100 are pivoted outwardly about the bolts 102. A curvilinear folding edge 112 is formed into the side edge of each underfolder 100 and extends from notch means or a notch 114 to a rounded distal end 116.

Figure 2:
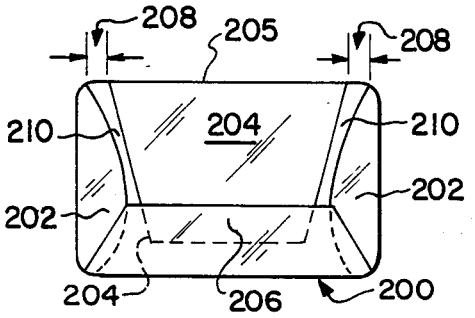
FIGS. 2 and 3 show, respectively, the underside of film wrapped family sized packages wrapped by a machine with conventional side folding levers using standard width film and oversized film.
Figure 3:
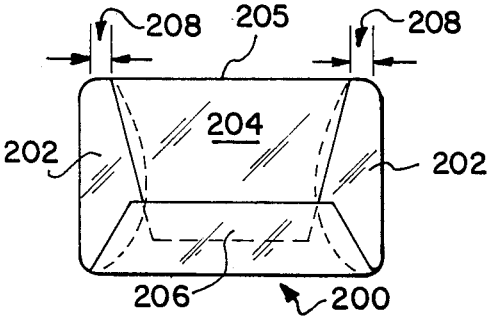

FIGS. 2 and 3 illustrate packages 200 wrapped by prior art wrapping machines utilizing film underfolding levers as shown in the referenced patent. The package 200 is an oversized or family sized package approximately 10 inches by 14 inches. As shown in FIG. 2, the package 200 was wrapped widthwise in a sheet of standard 18 inch film. Opposed first and second sides 202 of a film sheet were wiped or underfolded beneath the sides of the package 200 by the prior art side underfolders and the third or rear side 204 of the film sheet was wiped or underfolded from the rear 205 of the package by a rear underfolder. The fourth or front side 206 of the film sheet was then underfolded about the package 200 by pushing the package 200 onto an exit conveyor (see FIGS. 5–10) which also removes the wrapped package from the wrapping station.

As can be seen in FIG. 2, the prior art side underfolders of the referenced patent would infold the edges of the third or rear side 204 of the film sheet from the rear corners of the package 200 by infold distances or infolds 208 before the rear underfolder engages the rear side 204 of the film sheet and wipes it onto the underside of the package 200. Due to the infolds 208 caused by the shape of the folding edges of the prior art side underfolders, the rear side 204 of the film sheet fails to overlap the first and second opposed sides 202 of the film sheet, thus leaving gaps 210 between the edges of the underfolded sides 202,204 of the film sheet.

It is apparent that the gaps 210 prevent the underside of the package from being substantially covered by means of overlapping film which can be secured by means of the inherent cohesive nature of the film or by heat sealing techniques as are well known in the art. Accordingly, the package 200 shown in FIG. 2 is not satisfactorily sealed and may become unwrapped when handled, for example, by a prospective purchaser. The film cannot generally be sealed to the tray since the film, which is made, for example, of polyvinyl chloride, does not adhere to typical tray materials, such as paper pulp, polystyrene and polystyrene foams. The edges of the underfolded sides of the film sheet are generally not as definite as shown in FIG. 2 and the gaps 210 between the rear side 204 of the film sheet and the opposed first and second sides 202 have been exaggerated to exemplify one of the problems addressed by the invention of the present application.

To overcome the deficiencies of the wrap illustrated in FIG. 2 by eliminating the gaps 210, the width of the package handling path of the prior art wrapping machine was expanded to handle 21 inch film. By using 21 inch film to wrap an oversized family pack with the prior art wrapping machine, the necessary overlapping of the edges of the sides of the film sheet folded about a package is obtained to securely seal the package. As shown in FIG. 3, the first and second opposed sides 202 of a film sheet used to wrap the package 200 extend farther toward the center of the package due to the increased film width. Accordingly, the edges of the infolded third or rear side 204 of the film sheet overlaps the edges of the first and second sides 202 of the film sheet and the edges of the first and second sides 202 and the third side 204 are in turn overlapped by the fourth side 206 as it is underfolded about the package by ejecting the package from the wrapping station onto the exit conveyor.

While the prior art wrap of the package 200 as shown in FIG. 3 is reasonably satisfactory and accommodates the family sized packages as previously mentioned, the modification of the machine to utilize the wider 21 inch film is expensive. Film costs likewise increase, since each roll of 21 inch film used by the machine costs approximately 15% more than a roll of 18 inch film. Although the added expense per roll may not be great, assuming three rolls of wide film are used per week by the average supermarket, the savings over the operating life of a wrapping machine are considerable.

Figure 4:
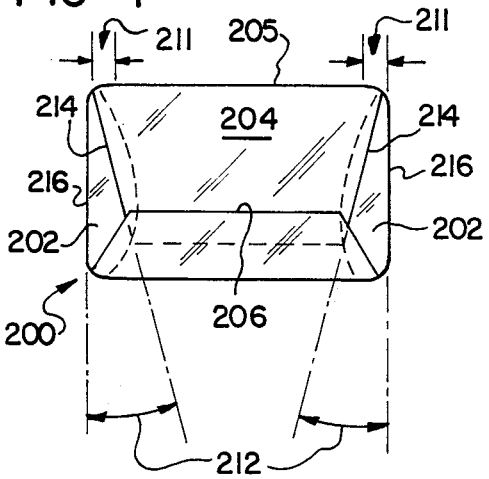
PRIOR ART FIG-4
FIG. 4 shows the underside of a film wrapped family sized package using the improved side folding levers of the present invention and standard width film.

By replacing the side underfolders of the prior art wrapping machine of the referenced patent with the improved side underfolders 100 of the present invention as shown in FIGS. 1 and 5–7, the family sized package 200 can be properly widthwise wrapped by the machine in standard 18 inch width film. As shown in FIG. 4, the infolded edges of the third or rear side 204 of the film sheet are each extended outwardly toward the sides of the package by an amount 211 which is substantially equivalent to the infold distance or infold 208 produced by the prior art side underfolder (see FIGS. 2 and 3). Hence, FIG. 4 illustrates that the infolds 208 are eliminated when the improved side underfolders 100 of the present invention are used.

Figure 7:
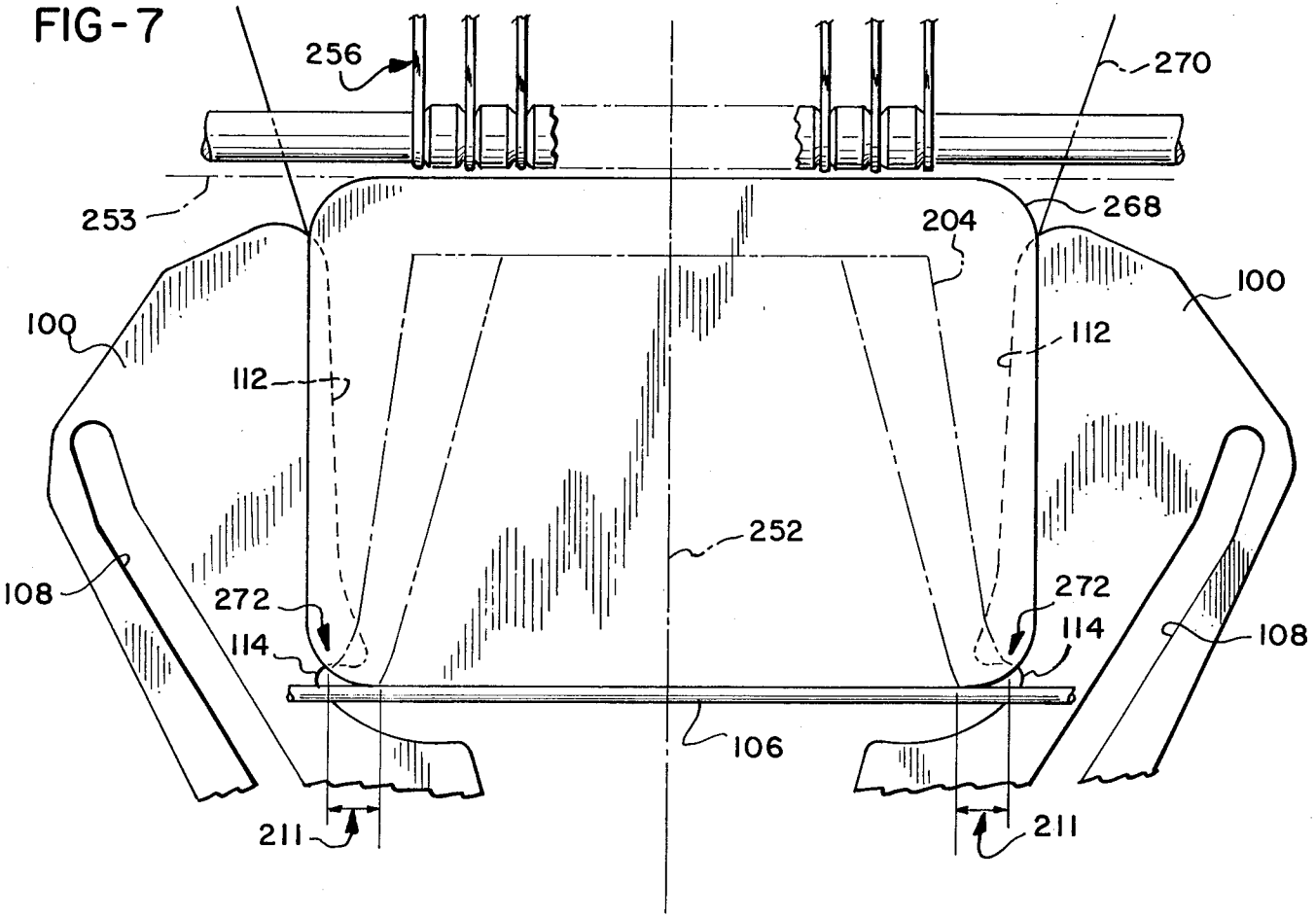

The notches 114 are positioned substantially adjacent to the rear edge of the family sized package 200, see FIG. 7, and serve to expand the spacing between the side underfolders 100 at the rear of the oversized family pack as the third or rear side 204 of the film sheet is engaged by the rear underfolder 106. The expanded opening between the side underfolders 100 delays the side infolding at the rear of the family sized package 200 to eliminate the infolds 208 and produce the wrap shown in FIG. 4 for the family sized package 200 in standard 18 inch wide film.

By delaying the side infolding at the rear of the oversized package 200, the edges of the third or rear side 204 of the film sheet are substantially adjacent the rear corners of the oversized package 200 when the rear underfolder 106 engages the third or rear side 204 of the film sheet. The edges of the third or rear side 204 of the film sheet are thus each extended outwardly toward the side edges of the package 200 by an amount 211 which is substantially equal to one of the infolds 208 produced by the prior art side underfolding levers.

It is also noted that the timing of the side underfolders 100 and the rear underfolder 106 as determined by the cam surfaces 108 and the cam drivers 110 may be set such that the angles 212 of the tapers of the third or rear side 204 of the film sheet are slightly reduced. Such reduced side tapers further extend the edges 214 of the third or rear side 204 of the film sheet outwardly toward the edges 216 of the package 200 and, thus, further utilize the standard 18 inch width film used by a wrapping machine incorporating the present invention.

Figure 5:
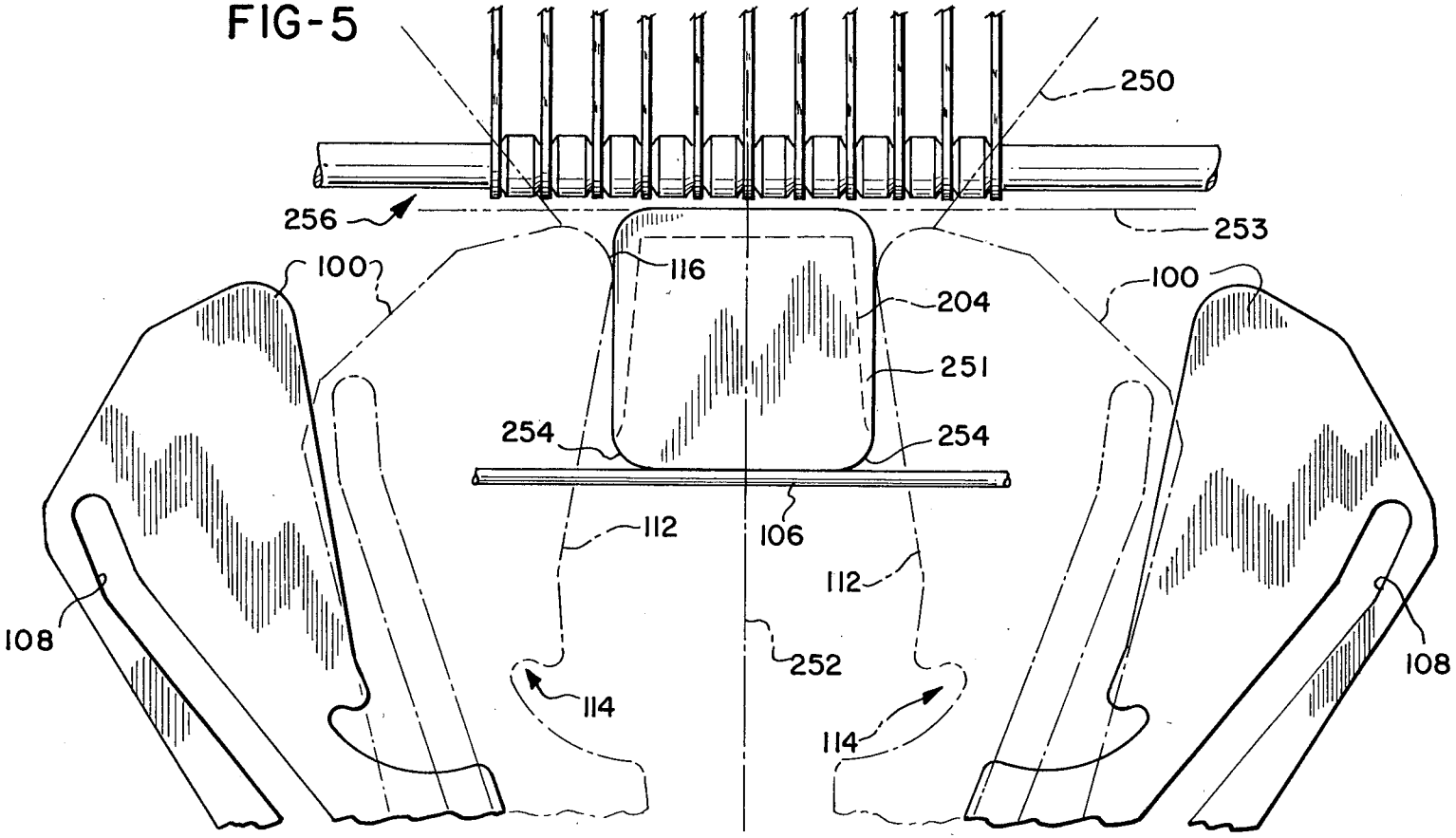
FIGS. 5–7 illustrate the operation of the improved side folding levers of the present invention for various package sizes.
Figure 6:
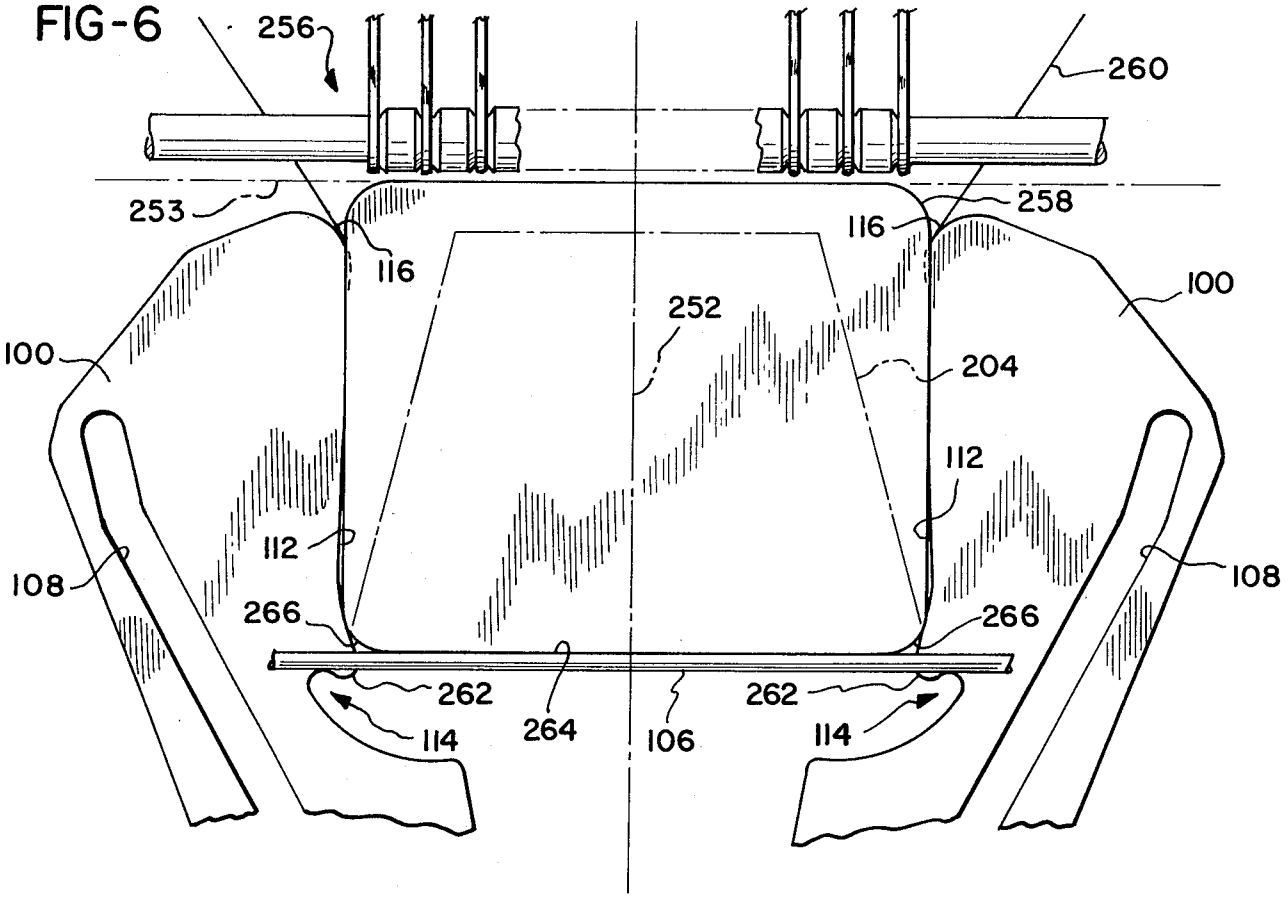

FIGS. 5 and 6 show the positioning of the improved side underfolders 100 in accordance with the present invention at the commencement of the underfolding of the third or rear side 204 of a film sheet for the smallest and largest of the packages in the standard range of package sizes, respectively. In FIG. 7, the positioning is shown for a family pack. The underfolding edge 112 between the notches 114 and the rounded distal ends 116 of the side underfolders 100 serves to wipe or fold the first and second opposed sides 202 of a film sheet under the sides of a package to be wrapped.

For the standard range of package sizes which varies from approximately 5 inches by 5 inches to approximately 9 inches by 12 inches, the underfolding edge 112 infolds the edges of the third or rear side 204 of the film sheet to be substantially adjacent to the rear corners of the package for engagement by the rear underfolder 106 which wipes or folds the third or rear side 204 of the film sheet beneath the package.

As shown in FIG. 5, a narrow width film sheet 250 of a standard width of 14 inches, for example, has been drawn into the wrapping machine in accordance with the referenced patent and prestretched above the smallest sized package 251 which is infed along a machine centerline 252 to a package registering line 253. The package 251 is then elevated into the film sheet 250 and through the original plane defined by the film sheet 250. The film sheet 250 is then engaged by the side underfolders 100 to wipe or fold the first and second opposed sides 202 of the film sheet 250 beneath the smallest size package 251.

In FIG. 5, the side underfolders 100 are shown in the fully extended position in solid lines, and, in dashed lines, at the position at which the third or rear side 204 of the film sheet 250 to be folded about the package 251 is engaged by the leading portion of the rear underfolder 106. The curvilinear folding edge 112 is formed such that the infolded edges of the third or rear side 204 of the film sheet 250 are positioned at approximately the rear corners 254 of the package 251 such that the third or rear side 204 of the film sheet 250 is folded onto the bottom of the package approximately as shown. The fourth side 206 of the film sheet 250 (see FIGS. 2–4, not shown in FIGS. 5–7) is underfolded about the package 251 as the package 251 is ejected by package pusher means from the wrapping station onto a package conveyor 256 to complete the wrapping of the package 251. The package pusher and the side tucking of the fourth side 206 of the film sheet as shown in FIGS. 2–4 are illustrated in the referenced patent.

FIG. 6 shows the approximate outline of the third or rear side 204 of a film sheet for wrapping the largest packages in the standard range of package sizes handled by the film wrapping machine of the referenced patent. A film sheet 260 of 18 inch wide film, for example, is drawn from a continuous source of such film and stretched above a package 258 in accordance with the referenced patent. The package 258 is then elevated into the film sheet 260 and through the initial plane defined by the film sheet 260. The side underfolders 100 and the rear underfolded 106 are then operated to fold three sides of the film sheet 260 under the package 258.

In FIG. 6, the side underfolders 100 are shown in the position at which the third or rear side 204 of the film sheet 260 to be folded about the package 258 is engaged by the leading edge of the rear underfolder 106. The underfolding edges 112 of the side underfolders 100 extend from the rounded distal ends 116 to curved fingers 262 which form the entryways into the notches 114 of the side underfolders 100. It can be seen in FIG. 6 that the fingers 262 extend beyond the rear edge 264 of the package 258 to infold the edges of the third or rear side 204 of the film sheet 260 to the rear corners 266 of the package 258 when the third or rear side 204 of the film sheet 260 is engaged by the leading edge of the rear underfolder 106. After the first and second opposed sides and the third side of the film sheet 260 have been underfolded by the side underfolders 100 and the rear underfolder 106, the package 258 is ejected onto the exit conveyor 256 at which time the fourth side 206 (not shown in FIG. 6) of the film sheet 260 is underfolded about the package 258.

In FIG. 7, a family sized package 268 measuring approximately 10 inches by 14 inches is shown to illustrate the operation of the present invention in wrapping family sized packages in standard 18 inch wide film. A film sheet 270 of 18 inch wide film is drawn from a continuous source of such film, stretched above the package 268 which is then elevated into the film sheet 270 and through the plane initially defined thereby. The film sheet 270 is then engaged by the side underfolders 100 and the rear underfolder 106.

The side underfolders 100, as shown in FIG. 7, are positioned at the point where the leading edge of the rear underfolder 106 engages the third or rear side 204 of the film sheet 270 to be folded about the package 268. As can be seen in FIGS. 7–10, the sides of the film sheet 270 are received by the notches 114 of the side underfolders 100 to delay the infolding of the third or rear side 204 of the film sheet 270. Each of the edges of the third or rear side 204 of the film sheet 270 is thus extended by an amount 211 which is substantially equivalent to one of the infolds 208 which would be effected by the prior art side underfolders of the referenced patent when wrapping family packs. Accordingly, the underfolding of the third or rear side 204 of the film sheet commences at the outermost positions 272 which are substantially at the rear corners of the family sized package 268.

Figure 8:
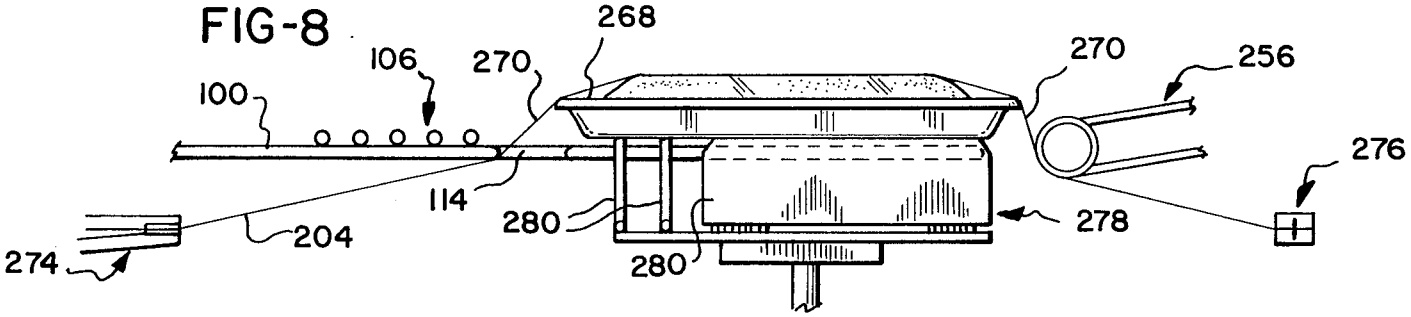
FIGS. 8–10 show film handling by the improved side folding levers of the present invention for delayed infolding.
Figure 9:
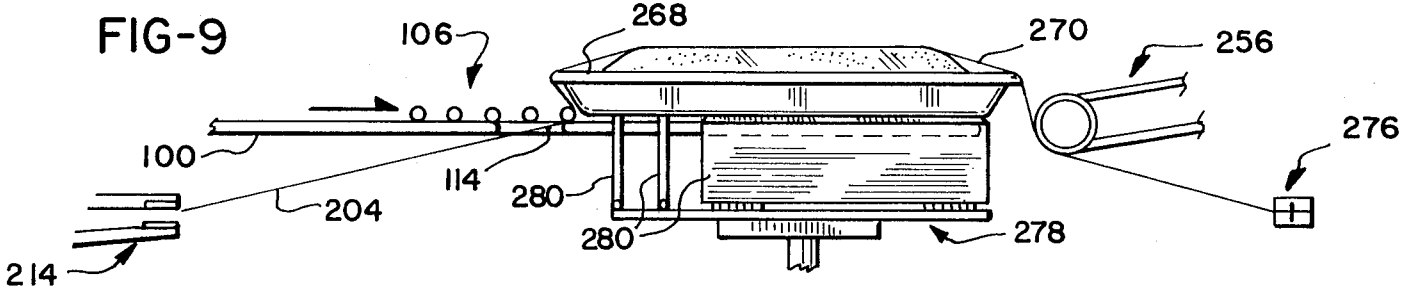
Figure 10:
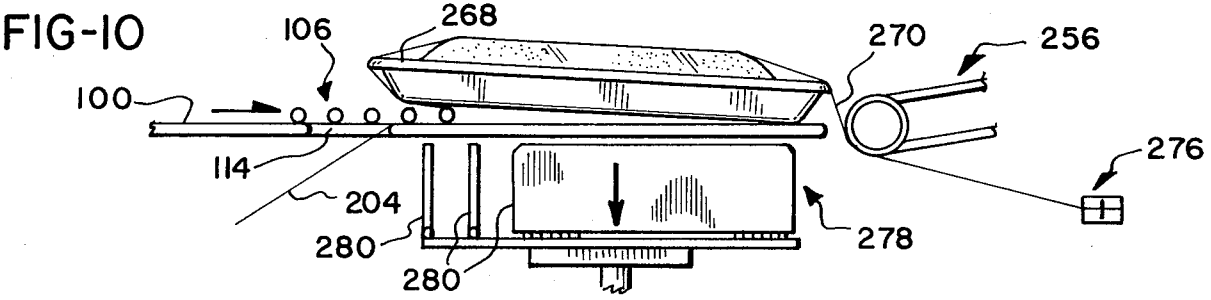

Side views of the operation of the rear underfolder 106 with the film sheet 270 engaged within one of the notches 114 of the side underfolders 100 are shown in FIGS. 8–10. In particular, the film sheet 270 is pulled horizontally from a film roll, stretched longitudinally between a film gripper 274 and a film clamp and cutter 276, and stretched laterally between film side clamps as illustrated in the referenced patent. The package 268 has been elevated through the initial plane defined by the film sheet 270 by an elevator 278 having collapsible slats 280 which are collapsed by the side underfolders 100 and the rear underfolder 106 as is well known in the art. The film sheet 270 is received within the notches 114 as best shown in FIGS. 8–10 to delay or limit the infolding of the third or rear side 204 of the film sheet 270 such that the infolding of the edges of the third or rear side 204 of the film sheet has only progressed to the rear corners 272 of the package 268 when engaged by the leading portion of the rear underfolder 106.

The film clamp and cutter 276 serves not only to sever a film sheet from a continuous source of wrapping material, but also clamps the film for film stretching purposes. The operation of the film cutter 276 may be delayed until the package 268 is fully elevated into the film sheet 270 to stress the sheet 270 and thereby pull additional film from the continuous supply prior to severing the sheet 270 from the supply. For a more detailed description of extended film draw which may be advantageously used in combination with the present invention, reference is made to U.S. patent application Ser. No. 640,053, entitled "Extended Film Draw for Film Wrapping Machine," filed on even date herewith by Fritz F. Treiber et al. and assigned to the same assignee as the present application.

An improved method and apparatus for modifying existing film wrapping machines to wrap family sized packages in standard width film without requiring extensive changes to the wrapping machines have been disclosed. In accordance with this method and apparatus, the machine functions normally to wrap an extended range of standard package sizes for which the machine was originally designed, but can also wrap family sized packages in standard width film. The method and apparatus are also useful on new machines to enable a wider range of package sizes to be wrapped in a given width film.

While the method herein described and the form of apparatus for carrying the method into effect constitute a preferred embodiment of this invention, it is to be understood that the invention is not limited to this precise method and form of apparatus and that changes may be made in either without departing from the scope of the invention which is defined in the appended claims.

What is claimed is:

1. In a wrapping machine for wrapping film sheets about an extended range of package sizes, a method for wrapping oversized packages which exceed the largest size package of said extended range in a standard width film sheet comprising the following steps:

conveying an oversized package to a package elevator;

securing a film sheet in a plane above said package;

elevating said oversized package into said film sheet and through the plane initially defined by said film sheet;

moving said underfolders, each comprising a curvilinear folding edge, and a rear underfolder into engagement with said film sheet to thereby fold first and second opposed sides of said film sheet beneath said package with a third side being folded to overlap the edges of said first and second opposed sides of said film sheet;

maintaining a standard spacing between said side underfolders from a rounded distal end of said folding edges to a rear end of said folding edges;

expanding the standard spacing between said side underfolders at the rear end of said folding edges adjacent to the rear of said oversized package to delay the side infolding at the rear of said oversized package such that the infolded edges of the third side of said film sheet is adjacent the rear corners of said oversized package when said rear underfolder engages said third side to place the edges of said third side nearer the sides of said package and ensure that the edges of said third side of said film sheet overlap the edges of said first and second opposed sides of said film sheet; and ejecting said package from said wrapping machine to fold the remaining fourth side of said film sheet onto the underside of said package whereby the underside of said package is entirely covered by the overlapped edges of the underfolded sides of said film sheet.

2. A method for wrapping oversized packages as claimed in claim 1 wherein the step of expanding the standard spacing between said side underfolders at the rear end of said folding edges adjacent to the rear of said oversized package comprises forming notches into the rear end of said folding edges of said side underfolders.

3. A method for wrapping oversized packages as claimed in claim 2 further comprising the step of tucking and rolling the infolded edges of the third side of said film sheet by forming the trailing edges of said notches to engage the infolded edges of said third side of said film sheet to thereby tuck and roll said infolded edges.

4. In a wrapping machine for wrapping a film sheet about a package by means of side folding levers and a rear folder, improved side folding levers for wrapping said package in a reduced width film, each improved side folding lever comprising:

a planar folding blade;

pivot means located near one end of said folding blade for mounting said folding blade for horizontal pivotal movement;

a curvilinear folding edge formed into the side of said folding blade, said folding edge having a rounded distal end; and notch means formed at the inner end of said curvilinear folding edge and substantially aligned with the rear edge of said package as said package is wrapped for receiving a film sheet to delay the infolding of said film sheet about said package whereby the infolded edges of the rear of said film sheet are positioned substantially at the rear corners of said package as said film sheet is engaged by the rear folder.

5. An improved folding lever as claimed in claim 4 wherein said notch means comprises a curvilinear trailing edge which serves to tuck and roll the infolded edges of the rear of said film sheet as it is folded by said rear folder.

6. In a wrapping machine for wrapping varying sized film sheets about an extended range of correspondingly sized packages by means of side folding levers and a rear folder which cooperates with said side folding levers, improved side folding levers for wrapping oversized packages in standard width film, each improved side folding lever comprising:

a planar folding blade;

pivot means located near one end of said folding blade for mounting said folding blade for horizontal pivotal movement;

a curvilinear folding edge formed into the side of said folding blade, said folding edge extending over approximately the forward one-third of said blade and terminating in a rounded distal end; and notch means formed at the inner end of said folding edge and substantially aligned with the rear edge of an oversized package as said oversized package is wrapped for receiving a film sheet as it is folded about said oversized package to delay the infolding of said film sheet about the rear edge of said oversized package whereby the infolded edges of the rear of said film sheet are positioned substantially at the corners of said oversized package as the rear of said film sheet is engaged by the rear folder.

7. An improved side folding lever as claimed in claim 6 wherein said notch means comprises a curvilinear trailing edge which serves to tuck and roll the infolded edges of the rear of said film sheet as it is folded by said rear folder.

8. In a wrapping machine for wrapping a wide range of sizes of rectangular packages in selected widths and lengths of stretch film wherein each of said packages is fed into said machine along a machine centerline and positioned at a front registering line below a prestretched film sheet and then elevated until the entire package is above the initial plane of said prestretched film sheet, said wrapping machine including a pair of planar side underfolders mounted on opposite sides of said centerline for horizontal pivotal movement toward and away from said centerline, said side underfolders defining folder edges and being movable from outer positions outside the range of the largest packages to be wrapped to inner positions for wiping opposed first and second sides of said film sheet beneath a package to be wrapped, a rear underfolder reciprocated along said centerline toward and away from said front registering line in a horizontal plane immediately above the plane of said side underfolders for wiping a third side of said film sheet beneath the package from the rear thereof after the opposed first and second sides have been effectively underfolded, said side and rear underfolders moving in unison beneath the package to underfold said first, second and third sides of said film sheet beneath packages within said size range in overlapped engagement, and a pusher for pushing each package onto a conveyor and thereby underfold the fourth side of said film sheet beneath the package whereby the edges of said sides of said film sheet overlap one another to completely cover the package bottom for sealing said package, the improvement comprising:

means for wrapping oversized packages which are wider and longer than the largest standard package size accommodated by said machine with the maximum width film normally used by said machine, said means comprising a notch in the folding edges of each of said side underfolders, which notches are generally aligned with the rear edges of said oversized packages, the depth of said notches being such that the rear side of said film sheet being underfolded, when wrapping such oversized packages, enters said notches to delay side underfolding adjacent the rear edge of said oversized packages to thereby expand the width of the third side of said film sheets to extend from substantially the rear corners of said oversized packages.

9. The improvement as claimed in claim 8 wherein the notch in each of said side underfolders comprises a curvilinear trailing edge which serves to tuck and roll the infolded edges of the rear side of said film sheet as it is folded by said rear underfolder.

10. In a wrapping machine for wrapping a first range of sizes of rectangular packages in selected lengths of a first width of stretch film and a second range of sizes of rectangular packages in selected lengths of a second width of stretch film by means of side folding levers and a rear folder which cooperates with said side folding levers, improved side folding levers for expanding said second range of package sizes to wrap oversized packages in said second width of stretch film to thereby expand the overall range of rectangular package sizes encompassing said first and second ranges which abut with and complement one another, each of said improved side folding levers comprising:

a planar folding blade defining a folding edge;

pivot means for mounting said folding blade for horizontal pivotal movement of said blade about one end thereof;

a notch formed into said folding edge and being generaly aligned with the rear edges of said oversized packages as said oversized packages are wrapped such that film being folded about said oversized packages by said underfolders enters said notches to delay the infolding of said film about the rear edges of said oversized packages whereby the infolded edges of said film are positioned substantially at the rear corners of said oversized packages when engaged by said rear folder.

11. An improved side folding lever as claimed in claim 10 wherein said notch comprises a curvilinear trailing edge which serves to tuck and roll the infolded edges of said film as it is folded by said rear folder.

* * * * *

UNITED STATES PATENT AND TRADEMARK OFFICE

CERTIFICATE OF CORRECTION

PATENT NO. : 4,574,564

DATED : March 11, 1986

INVENTOR(S) : Andrew Louis Pester

It is certified that error appears in the above-identified patent and that said Letters Patent are hereby corrected as shown below:

Col. 7, line 64, "underfolded" should read --underfolder--.

Col. 9, line 43, "said" should read --side--.

Col. 11, line 15, "folder" should read --folding--.

Signed and Sealed this

*Second* Day of *September 1986*

[SEAL]

*Attest:*

DONALD J. QUIGG

*Attesting Officer*

*Commissioner of Patents and Trademarks*